US007171723B2

(12) United States Patent
Kobayashi et al.

(10) Patent No.: US 7,171,723 B2
(45) Date of Patent: Feb. 6, 2007

(54) FLOOR SUCTION TOOL FOR ELECTRIC VACUUM CLEANERS

(75) Inventors: Toshinari Kobayashi, Ono (JP); Hidetoshi Fukuoka, Kanzaki-gun (JP); Yoshiaki Matsumoto, Kasai (JP)

(73) Assignee: Sanyo Electric Co., Ltd., Moriguchi (JP)

( * ) Notice: Subject to any disclaimer, the term of this patent is extended or adjusted under 35 U.S.C. 154(b) by 465 days.

(21) Appl. No.: 10/693,974

(22) Filed: Oct. 28, 2003

(65) Prior Publication Data

US 2004/0083574 A1 May 6, 2004

(30) Foreign Application Priority Data

Oct. 28, 2002 (JP) ..... 2002-312383

(51) Int. Cl.
*A47L 9/02* (2006.01)

(52) U.S. Cl. ..... 15/325; 15/415.1; 15/418

(58) Field of Classification Search ..... 15/325, 15/415.1, 418, 354
See application file for complete search history.

(56) References Cited

U.S. PATENT DOCUMENTS 3,491,399 A * 1/1970 Burgoon et al. ..... 15/354
4,499,628 A 2/1985 Platt
5,084,934 A * 2/1992 Lessig et al. ..... 15/325
6,584,640 B2 * 7/2003 Vanderlinden ..... 15/418

FOREIGN PATENT DOCUMENTS

| | | |
|---|---|---|
| EP | 0 649 625 A2 | 4/1995 |
| GB | 457394 | 11/1936 |
| JP | U-3-949 | 1/1991 |
| JP | A-8-206043 | 8/1996 |
| JP | A-8-317886 | 12/1996 |
| JP | 2002-512 | 1/2002 |

* cited by examiner

*Primary Examiner*—Theresa T. Snider
(74) *Attorney, Agent, or Firm*—Buchanan Ingersoll & Rooney PC

(57) ABSTRACT

A floor suction tool for electric vacuum cleaners includes a suction opening formed on a bottom face of a main body casing, a cover defining a front wall of the main body casing, and an abutting member projecting from a front face of the cover and functioning as a bumper between a front face of the main body casing and a wall. The cover is rotatably supported on a rotation axis formed horizontally in a direction of width of the front wall of the main body casing, the cover rotates upward to open the front face of the main body casing when a front-to-back force acts on the abutting member, and the cover rotates downward to close the front face of the main body casing when the front-to-back force ceases.

18 Claims, 17 Drawing Sheets

FLOOR SUCTION TOOL FOR ELECTRIC VACUUM CLEANERS

CROSS-REFERENCE TO RELATED APPLICATION

This application is related to Japanese application No. 2002-312383 filed on Oct. 28, 2002, whose priority is claimed under 35 USC § 119, the disclosure of which is incorporated by reference in its entirety.

BACKGROUND OF THE INVENTION

1. Field of the Invention

The present invention relates to a floor suction tool for electric vacuum cleaners. Particularly the floor suction tool can efficiently suck dust gathering at walls.

2. Description of the Background Art

Common floor suction tools have suction openings only on bottom faces of main body casings of the suction tools. For this reason, it is difficult to clean places with upright obstacles such as walls, legs of furniture and the like.

To cope with this problem, there have been proposed, suction tools capable of cleaning at walls and the like, such as suction tools constructed to suck dust at walls and the like by moving upward or turning backward flaps or sealing members mounted on lower parts of front faces of bodies of the suction tools when the bodies of the suction tools are pushed against walls and the like. See Japanese Patent Laid-Open Nos. 1996-3 17886 and 1996-206043, for example.

Also suction tools having rotary plates have been proposed. The rotary plate has the shape of an arch in a sectional view in a direction perpendicular to the rotation axis of a rotary brush. The arch shape has a greater diameter than the rotation trajectory of the tips of bristles of the rotary brush. The rotary plate opens and closes a front face of a body of the suction tool. The rotary plate is mounted on the body of the suction tool in a freely rotatable manner about a rotation axis that is co-axial to the rotation axis of the rotary brush. The rotary plate is manually operated to open or close the front face of the body of the suction tool. See Japanese Published Unexamined Utility Model Application No. 1991-949, for example.

However, even if the lower part of the front of the body of the suction tool is opened for sucking dust as disclosed in Japanese Patent Laid-Open Nos. 1996-317886 and 1996-206043, the suction opening does not come sufficiently close to a wall because a front wall of the body of the suction tool partially remains. For this reason, these conventional suction tools do not exhibit sufficient cleaning ability with regard to dust at walls.

Besides, the suction tool disclosed in Japanese Published Unexamined Utility Model Application No. 1991-949 is inconvenient because the rotary plate must be manually operated.

SUMMARY OF THE INVENTION

The present invention has been made to solve the above-described problems, and an object of the invention is to provide a floor suction tool for electric vacuum cleaners capable of efficiently sucking dust gathering at walls, or in corners defined between upright walls, furniture or obstacles and floors (hereinafter at walls or at a wall for simplicity), avoiding the marring of walls and furniture and providing a smooth move.

The invention provides a floor suction tool for electric vacuum cleaners including a suction opening formed on a bottom face of a main body casing, a cover defining a front wall of the main body casing; and an abutting member projecting from a front face of the cover and functioning as a bumper between a front face of the main body casing and a wall, wherein the cover is rotatably supported on a rotation axis formed horizontally in a direction of width of the front wall of the main body casing, the cover rotates upward to open the front face of the main body casing when a front-to-back force acts on the abutting member, and the cover rotates downward to close the front face of the main body casing when the front-to-back force ceases.

The abutting member may be formed to be a rotatable roller.

Preferably, at least a surface of the abutting member is formed of a soft, smooth material.

Preferably a fibrous material is used as the soft, smooth material. As the fibrous material, a cloth may be mentioned.

The cover may open the front face of the main body casing by rotating along an inside face of an upper case of the main body casing and being received in the upper case.

Preferably, the floor suction tool of the invention may be constructed to include, in the main body casing, a rotary brush having bristles fixed thereto radially. The rotary brush may be so formed that the tips of the bristles projects forward in relation to a trajectory of the cover when the cover opens.

The cover may be constructed to receive a spring force in a closing direction by a spring member attached to the rotation axis.

The cover may be so constructed that the own weight of the cover acts as a force in the closing direction.

These and other objects of the present invention will become more readily apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DETAILED DESCRIPTION OF THE PREFERRED EMBODIMENT

The present invention is now described in detail with reference to the drawings.

FIGS. 1 to 10 illustrate the construction and working of a floor suction tool 1 in accordance with an example of the invention.

Figure 1:
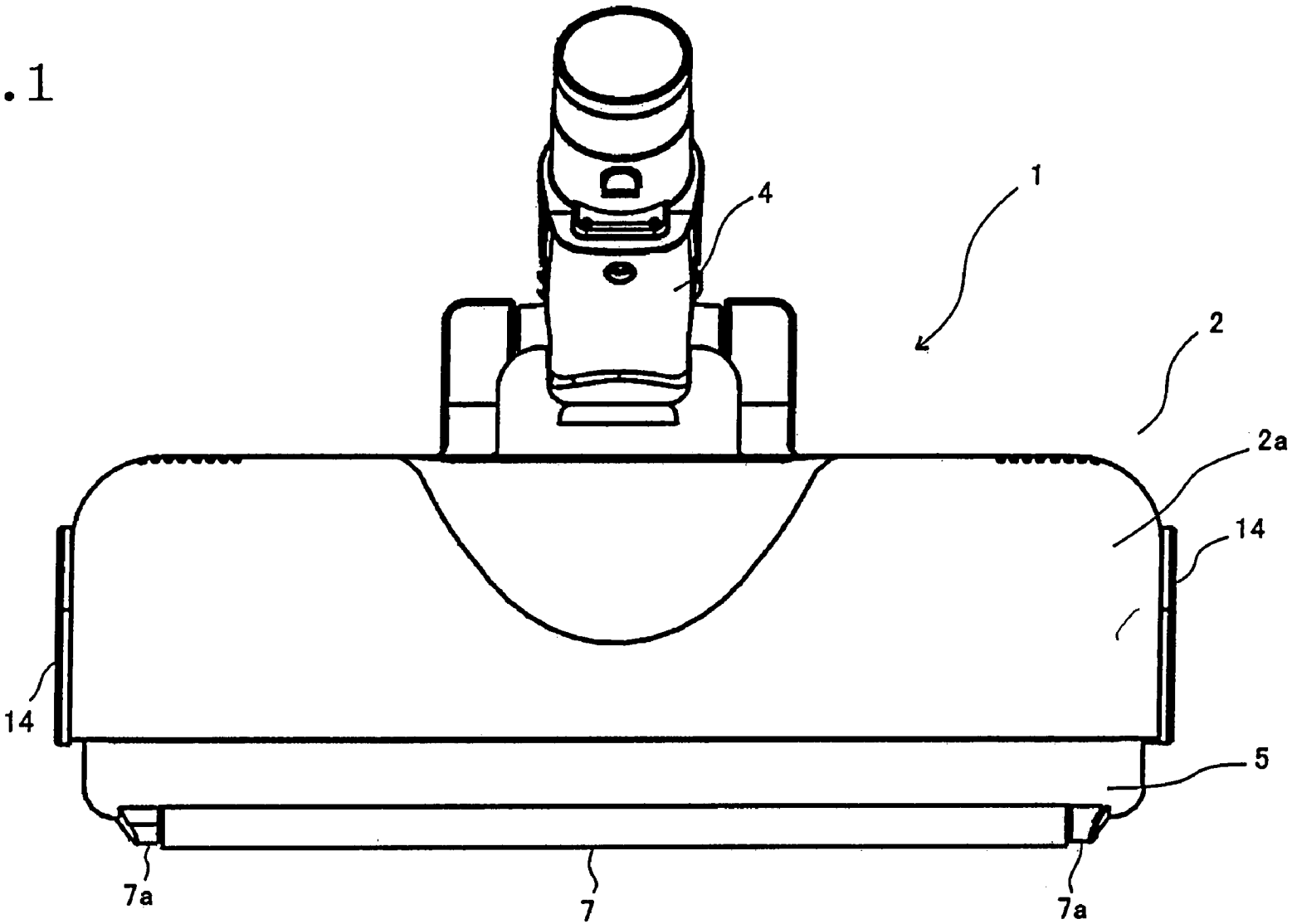
FIG. 1 is a top view of a floor suction tool in accordance with an example of the present invention.
Figure 2:
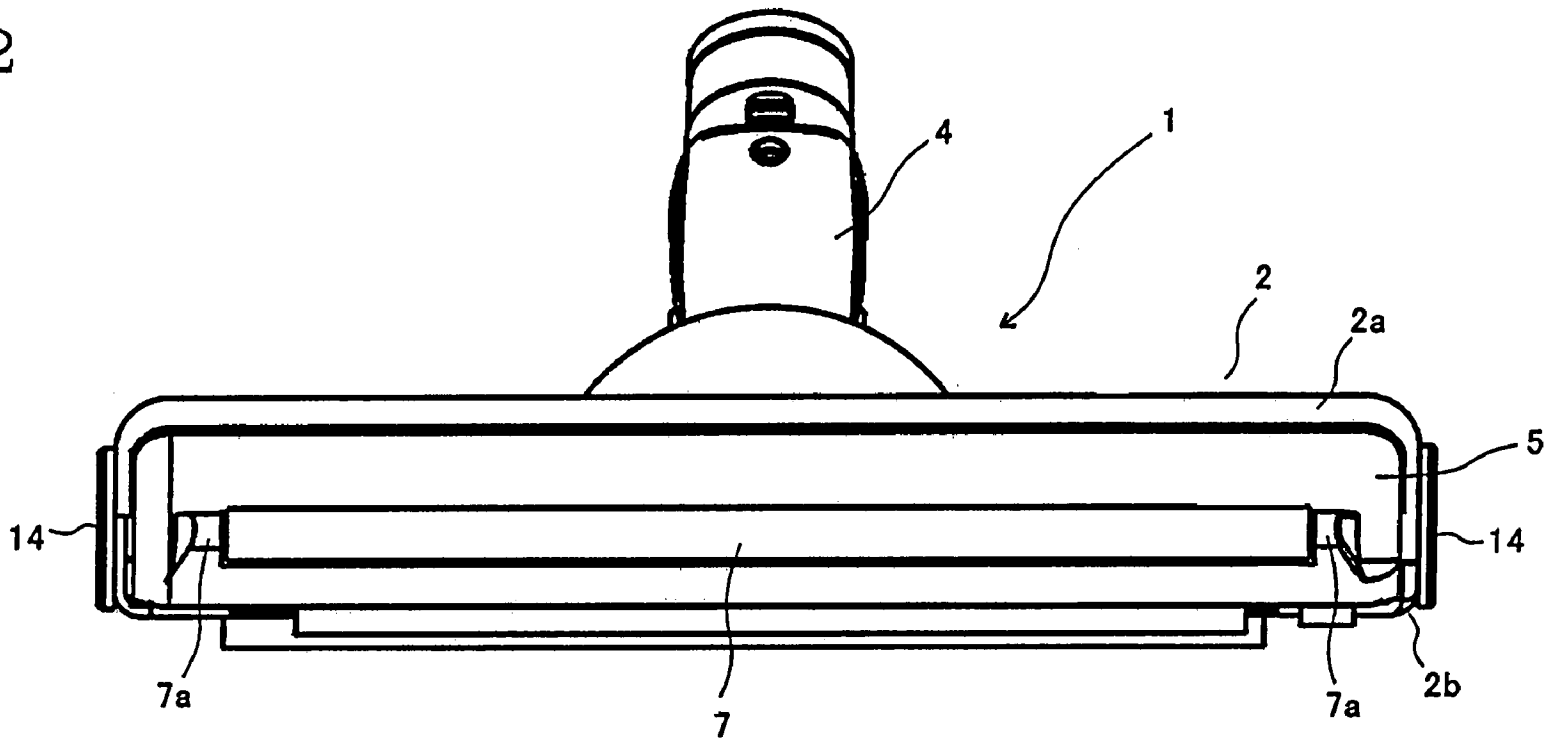
FIG. 2 is a front view of the floor suction tool.
Figure 3:
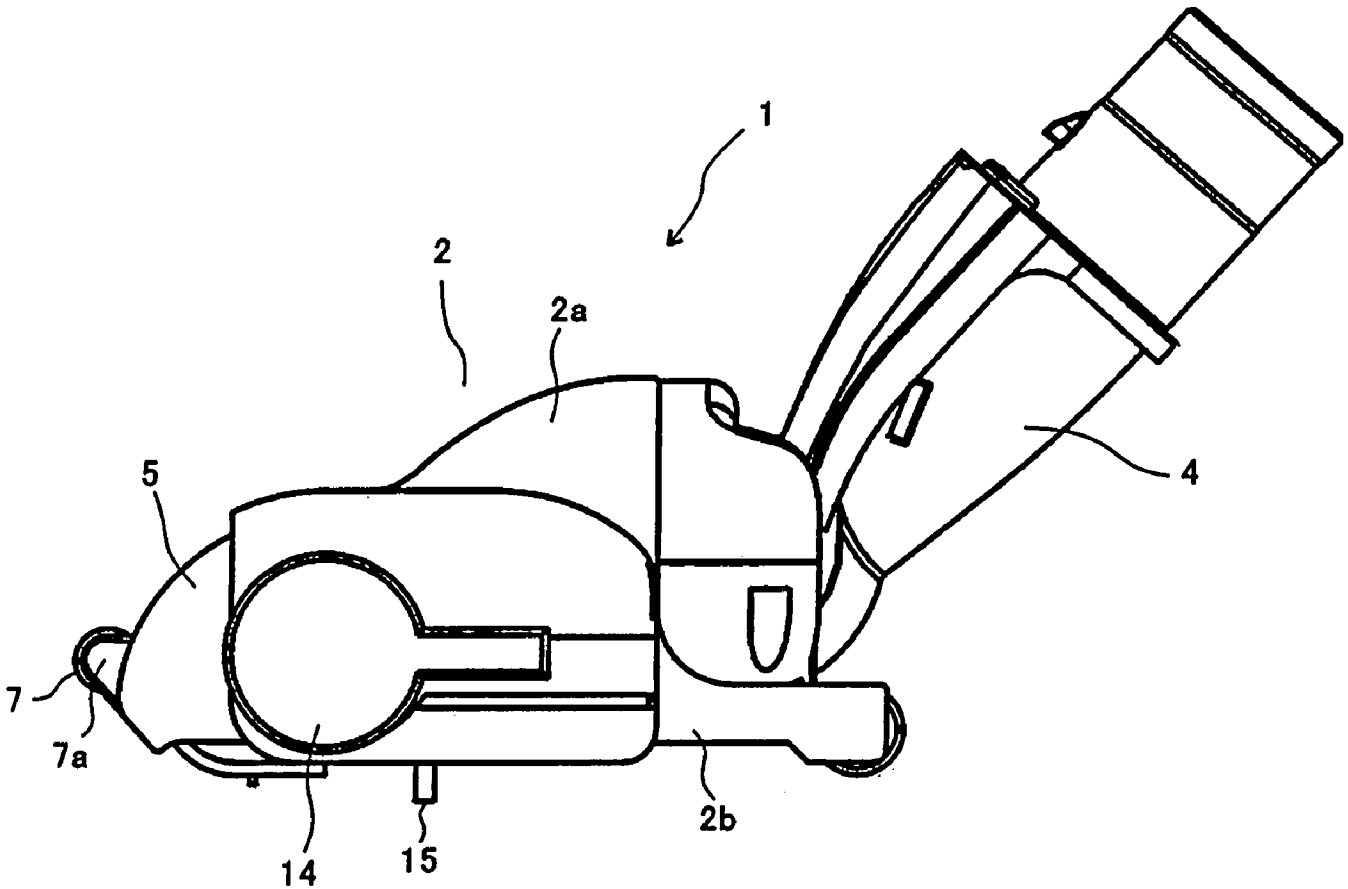
FIG. 3 is a side view of the floor suction tool.
Figure 4:
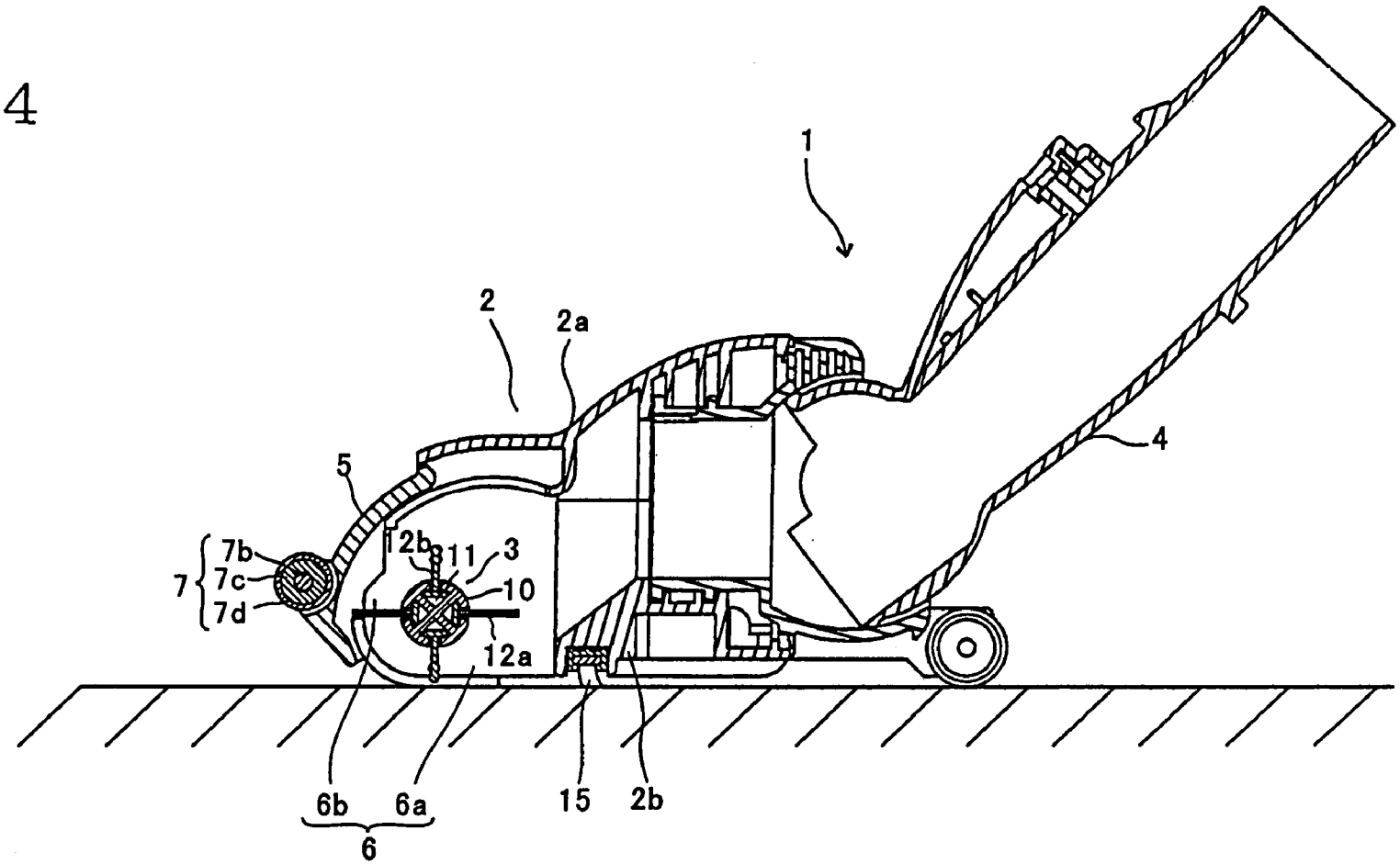
FIG. 4 is a vertical sectional view of a central part of the floor suction tool.

As shown in FIG. 4, the floor suction tool 1 shown in FIGS. 1 to 10 includes a laterally elongated main body casing 2 which is composed of an upper case 2*a* and a lower case 2*b* and has a suction opening 6, a rotary brush 3 supported in a freely rotatable manner by bearings on both ends within the main body casing 2 in the width direction as seen from the front of the main body casing 2, a bend 4 mounted on a rear face of the main body casing 2, the bend 4 being communicated to the suction opening 6 and being pivotable in all directions, and a cover 5 defining a front wall of the main body casing 2 and functioning to open and close the front wall of the main body casing 2. When the cover 5 opens, the suction opening 6 opens widely from a bottom face to a front face of the main body casing 2 and has a bottom portion 6*a* and a front portion 6*b*. When the cover 5 closes, the suction opening 6 has the bottom portion 6*a* alone. The bend 4 is connected to a vacuum cleaner by an extension tube or a hose.

The cover 5 is generally in a bent shape in cross section as shown in FIG. 4. An upper portion thereof is arch-shaped. A roller 7 is mounted on the cover 5 with both ends of the roller 7 supported in a freely rotatable manner by bearings 7*a*. The roller 7 functions as an abutting member or a bumper when the front of the floor suction tool 1 abuts to a wall. The outer side of the bearing 7*a* is tapered in a forward direction as shown in FIG. 7 so that the floor suction tool 1 can be smoothly moved if the outer side of the bearing 7*a* abuts to an obstacle during cleaning.

Figure 5:
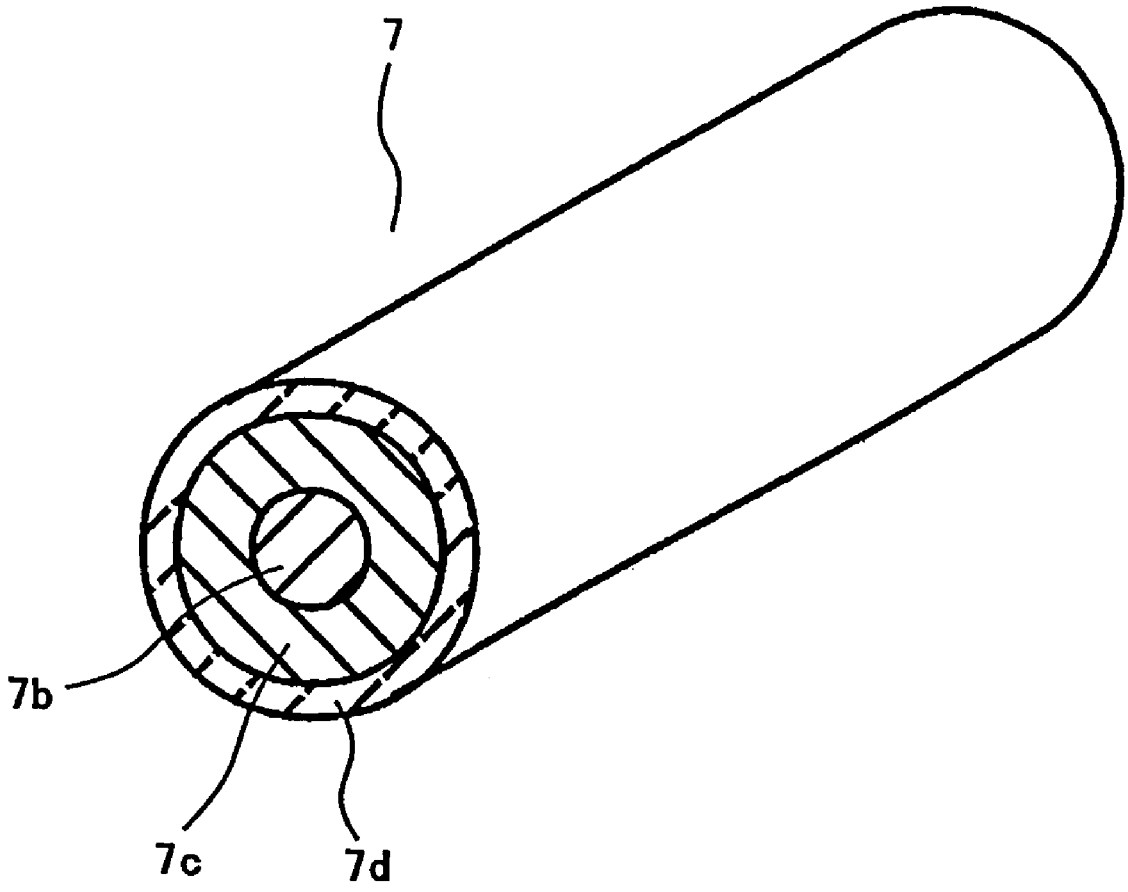
FIG. 5 is a perspective view of a roller of the floor suction tool which is vertically sectioned in part.

In the roller 7, a peripheral surface of a core 7*c* having a rotation axis 7*b* is covered with a cloth 7*d* which is a fibrous material as a soft, smooth abutting member, as shown in FIG. 5.

Figure 6:
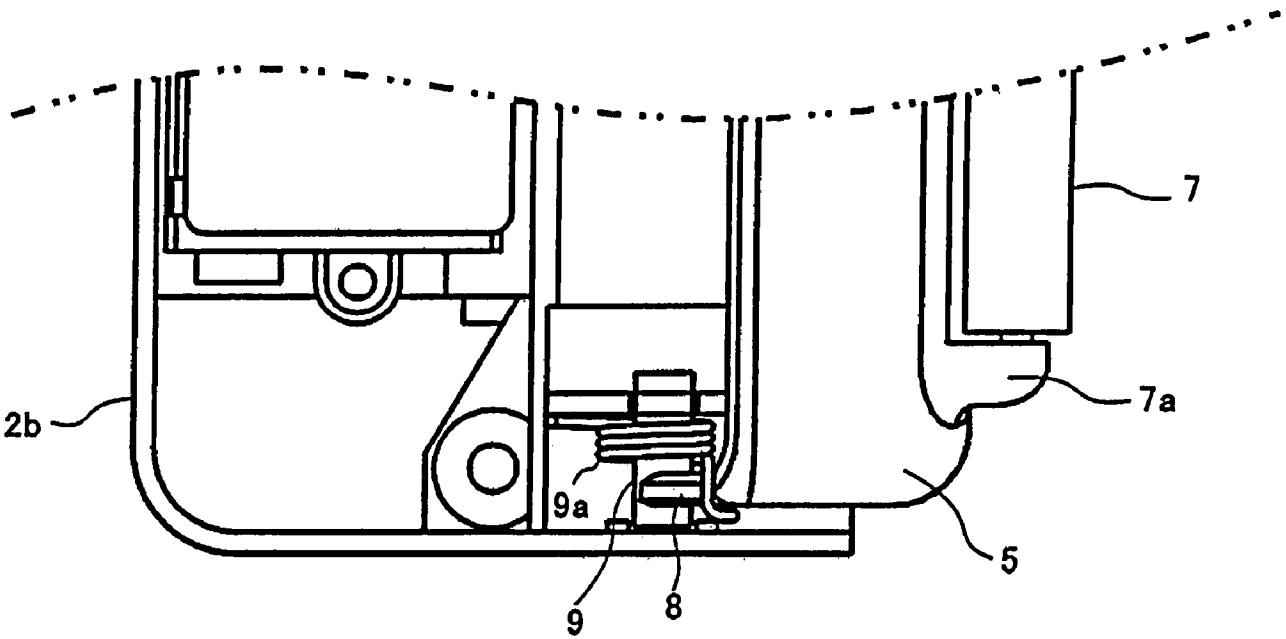
FIG. 6 is a top view of the floor suction tool with an upper case thereof removed.
Figure 7:
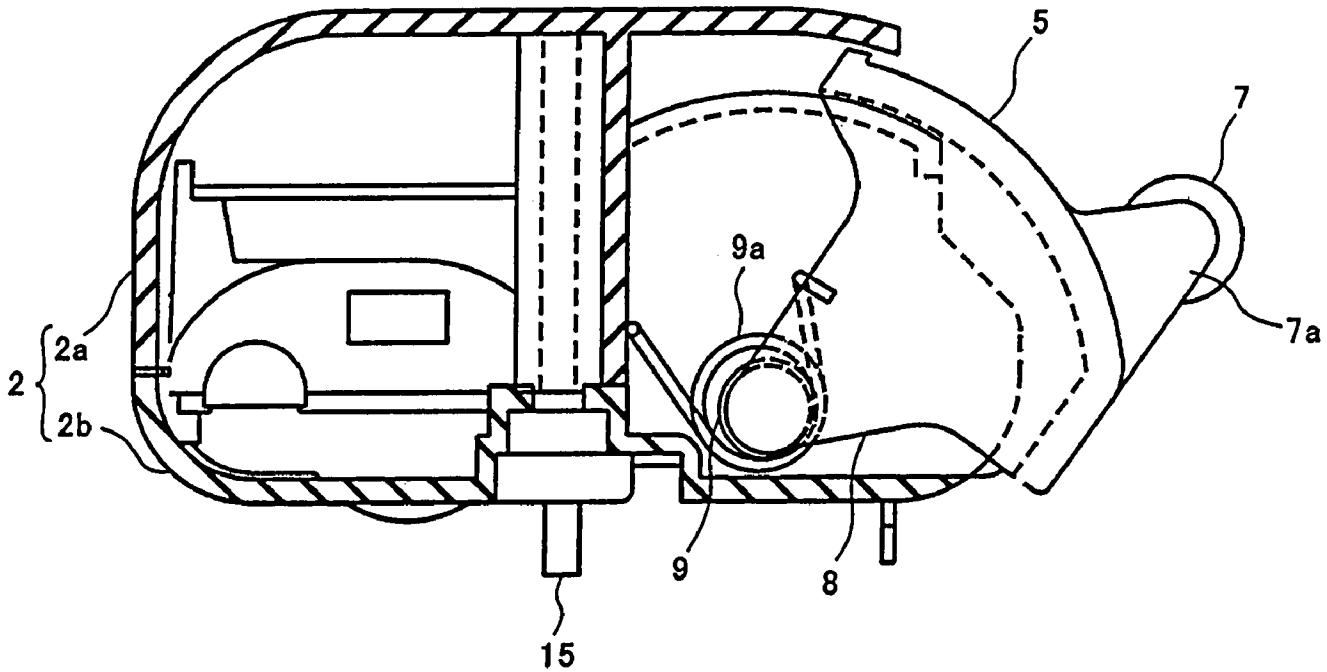
FIG. 7 is a sectional side view of the floor suction tool with the upper case thereof removed.

Arms 8 are formed integrally on both ends of the thus constructed cover 5 as shown in FIGS. 6 and 7. The arms 8 on the ends are supported in a freely rotatable manner about a rotation axis 9 which is formed, inside of both ends of the main body casing 2, horizontally in parallel with the front wall of the main body casing 2. The positional relationship between the rotation axis 9 and the roller 7 is such that the roller 7 is positioned above the rotation axis 9 which is the rotation center of the cover 5. With this construction, when the roller 7 is pressed against a wall W as shown in FIG. 7, that is, the roller 7 receives the front-to-back force, the roller 7 rotates anticlockwise as shown by an arrow in FIG. 8 so that the cover rotates upward.

Figure 8:
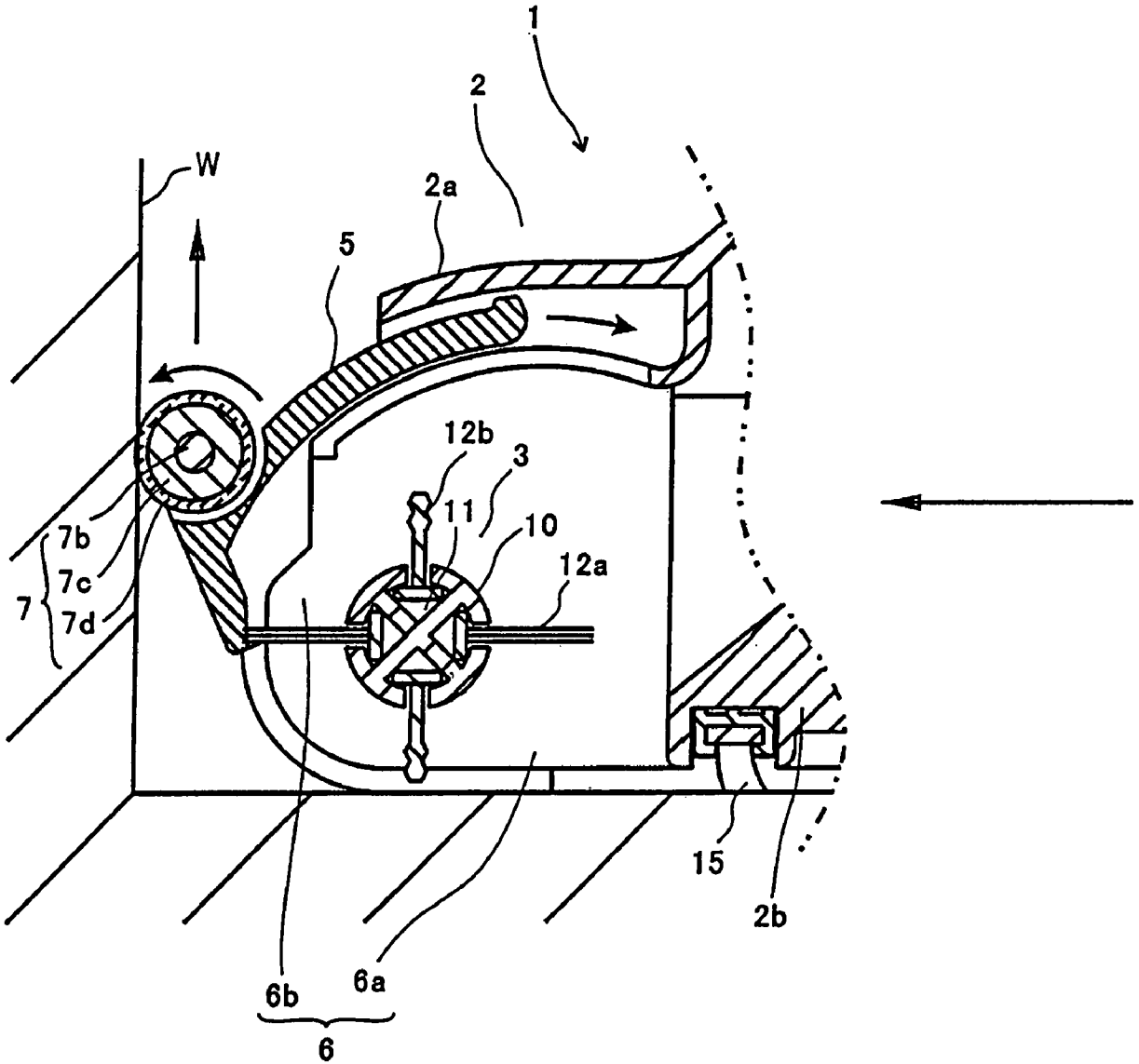
FIG. 8 is a vertical sectional view in part of the floor suction tool when a cover thereof is opening.

Also, as shown in FIG. 8, the cover 5 is constructed to rotate in such a direction that the cover 5 goes inside the upper case 2*a* of the main body casing 2 when the roller 7 abuts to the wall W and the cover 5 rotates upward.

Referring to FIGS. 6 and 7, a torsional spring 9*a* is mounted as a bias means for biasing the cover 5 so that the cover 5 rotates in a downward direction.

Figure 9:
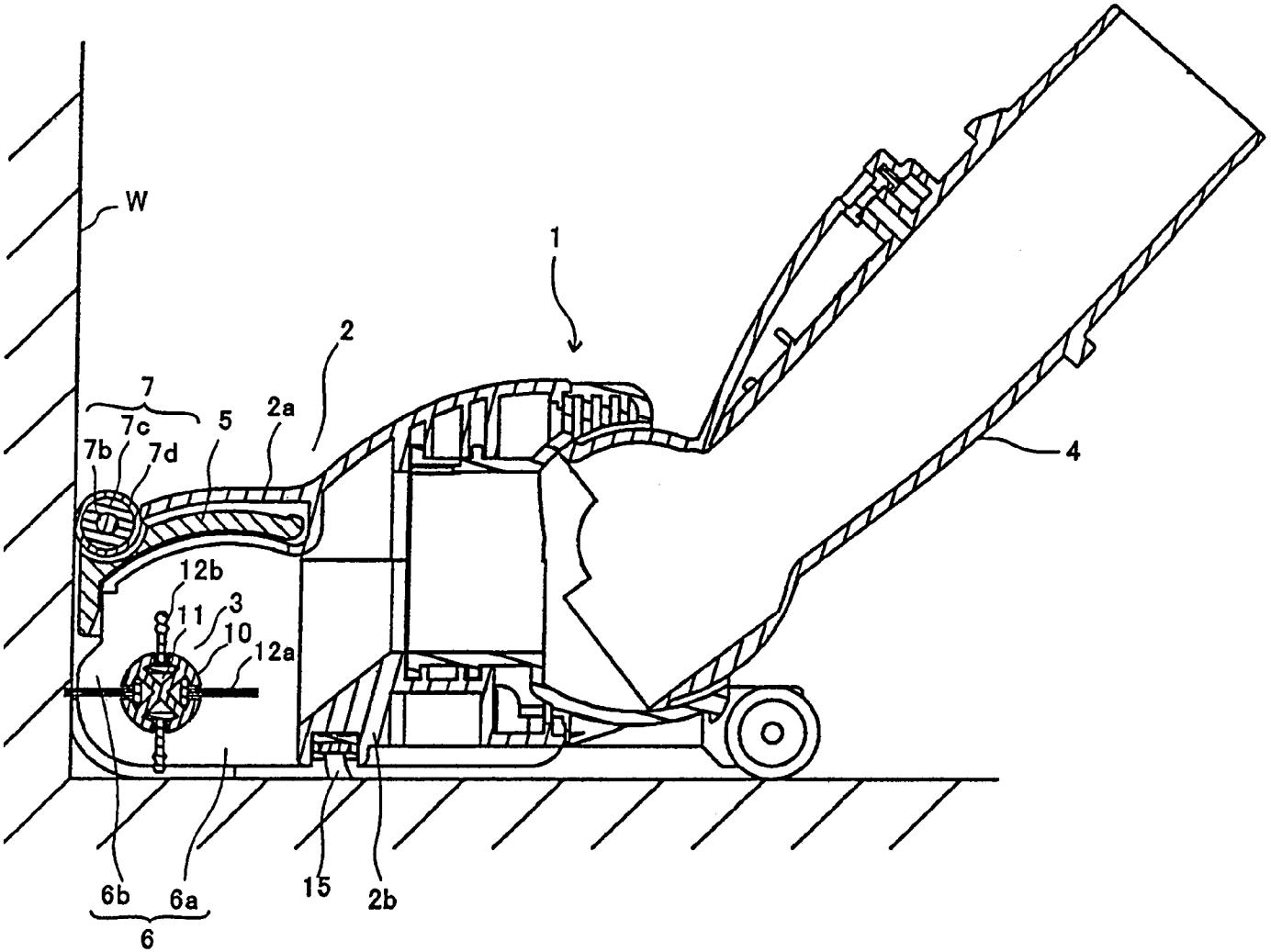
FIG. 9 is a vertical sectional view of the floor suction tool with the cover thereof opened.
Figure 10:
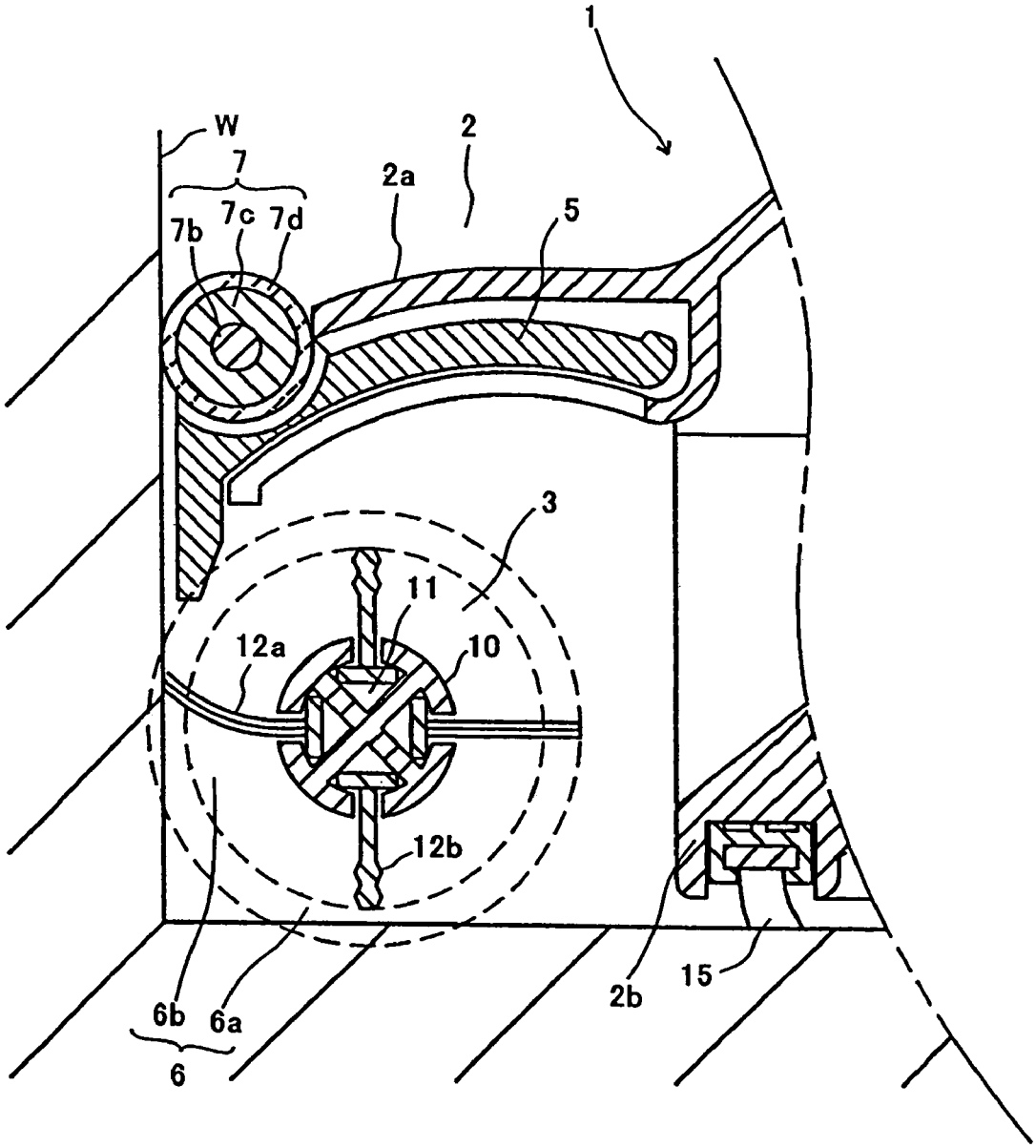
FIG. 10 is a vertical sectional view in part of the floor suction tool, illustrating a working of the floor suction tool when the cover is open.

Further, as shown in FIGS. 9 and 10, the rotary brush 3 has four helical grooves 11 in the longitudinal direction at intervals of 90 degrees on an outer periphery of a core 10. A pair of sets of bristles 12*a* and a pair of rubber blades 12*b* are alternately mounted in the grooves 11. The bristles 12*a* are longer than the rubber blades 12*b*. The positional relationship between the rotary brush 3 and the cover 5 is so set that the rotation trajectory of the tips of the bristles 12*a* comes ahead of the roller 7 when the cover 5 is open as shown in FIG. 9.

The rotary brush 3 is constructed to be rotationally driven by transmission of a drive force from an electric motor contained in the main body casing 2 via a transmission belt or the like, though that is not shown.

In this example, the roller 7 mounted on the cover 5 also functions as a bumper at the front of the main body casing 2, but side bumpers 14 are also mounted on both sides of the main body casing 2. A floor brush 15 is mounted on a rear side of the bottom portion 6*a* of the suction opening 6 along the width direction of the suction opening 6 as shown in FIGS. 4, 8, 9 and 10.

The thus constructed floor suction tool 1 of the example opens only the bottom portion 6*a* of the suction opening 6 in cleaning ordinary floors (e.g., floors carpeted with flooring, straw tatami mats, carpets, etc.) since, as shown in FIG. 4, the cover 5 is rotated down in a lower position by the biasing force of the torsional spring 9*a* mounted on the rotation axis 9 and closes the front portion 6*b* of the suction opening 6. Therefore, there does not occur a loss in the volume of suction air, and a desired volume of suction air can be obtained at the bottom portion 6*a* of the suction opening 6. In addition to that, the rotary brush 3 has a scraping effect. Thus the floor suction tool 1 provides an efficient floor cleaning.

On the other hand, in cleaning at a wall, the suction tool 1 is pushed against the wall W as shown in FIG. 8. Thereby, the roller 7 mounted on the cover 5 first abuts to the wall W and rotates as shown by an arrow to lift the cover 5. Then the cover 5 rotates about the rotation axis 9 in the direction in which the cover 5 is accommodated inside the upper case 2*a* of the main body casing 2. Thus the front portion 6*a* of the suction opening 6 is fully opened as shown in FIG. 9.

In the state shown in FIG. 9, the suction opening 6 is very close to the wall. Thus the floor suction tool 1 has a sufficient cleaning effect on dust at the wall. Furthermore, the dust at the wall can be sucked from both the bottom portion 6*a* and the front portion 6*b* of the suction opening 6. Moreover, the rotary brush 3 approaches or abuts to the wall W to scrape the dust at the wall. Consequently, the dust at the wall can be efficiently sucked.

In this example, because the cover 5 itself does not abut to walls or furniture but the roller 7 whose outer periphery is covered with the raising cloth abuts to the walls, the walls W and furniture can be positively prevented from being marred, and the cover 5 can be rotated very smoothly. The covering of the outer periphery of the roller 7 with the cloth also provides a smooth horizontal movement of the suction tool 1 in cleaning in the lateral direction with the roller 7 abutting to the wall W.

Because the roller 7 is mounted on the front of the main body casing 2, the roller 7 also functions as a bumper which absorbs shock when the front of the main body casing 2 hits an obstacle.

Further, because the cover 5 rotates along the inside of the main body casing 2 to be accommodated therein, it is possible to reduce the height of the suction tool 1 as compared with a suction tool whose cover 5 rotates along the outside of the main body casing 2. Therefore, when the suction tool 1 is used for cleaning a place of low height, for example, under a bed, there does not occur a problem that the cover 5 fails to open because of hitting an obstacle. The suction tool 1 also has a strengthened structure against external force.

When the cover 5 is open, the front-to-back positional relationship between the roller 7 and the bristles 12*a* and rubber blades 12*b* of the rotary brush 3 is such that the rotation trajectory of the tips of the bristles 12*a* is ahead of the roller 7 and contacts the wall W in a state in which the roller 7 abuts to the wall W, as shown in FIG. 10. Therefore, dust on and at the wall W can be efficiently sucked. Since the rubber blades 12*b* produce an unusual noise on hitting the wall, the rubber blades 12*b* are positioned so as not to contact the wall W in the above-mentioned state.

When an ordinary floor is cleaned after the above-described cleaning at the wall, the cover 5 is rotated downward by the biasing force of the torsional spring 9*a* to close the front portion 6*b* of the suction opening 6 only by moving the suction tool 1 off the wall W. Thus the ordinary floor can be cleaned in an ordinary manner.

The cover 5 can be rotated downward only by its own weight to close the front portion 6*b* of the suction opening 6. However, by the provision of the torsional spring 9*a* for rotating the cover 5 downward as in this example, the front portion 6*b* can be reliably closed even if dust adheres to the rotation axis 9 of the cover 5.

Figure 11:
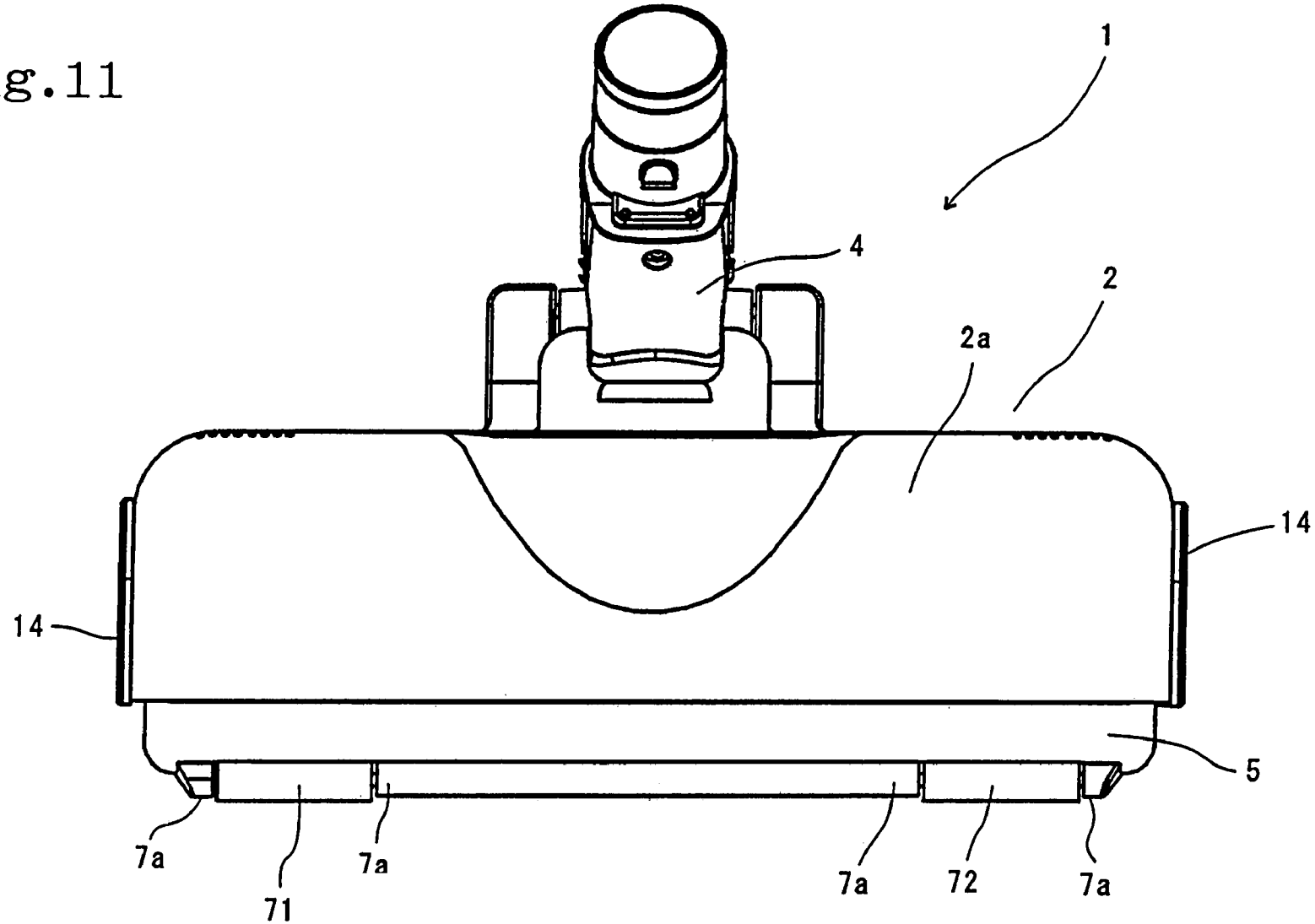
FIG. 11 is a top view of a floor suction tool in accordance with another example of the present invention.

In the above-described example, the single roller 7 is provided along the width direction of the cover 5. However, the invention is not limited thereto. For example, as shown in FIG. 11, short rollers 71 and 72 may be mounted on both sides of the cover 5 in the width direction and be supported rotatably on bearings 7*a* mounted on the front of the cover 5.

Figure 12:
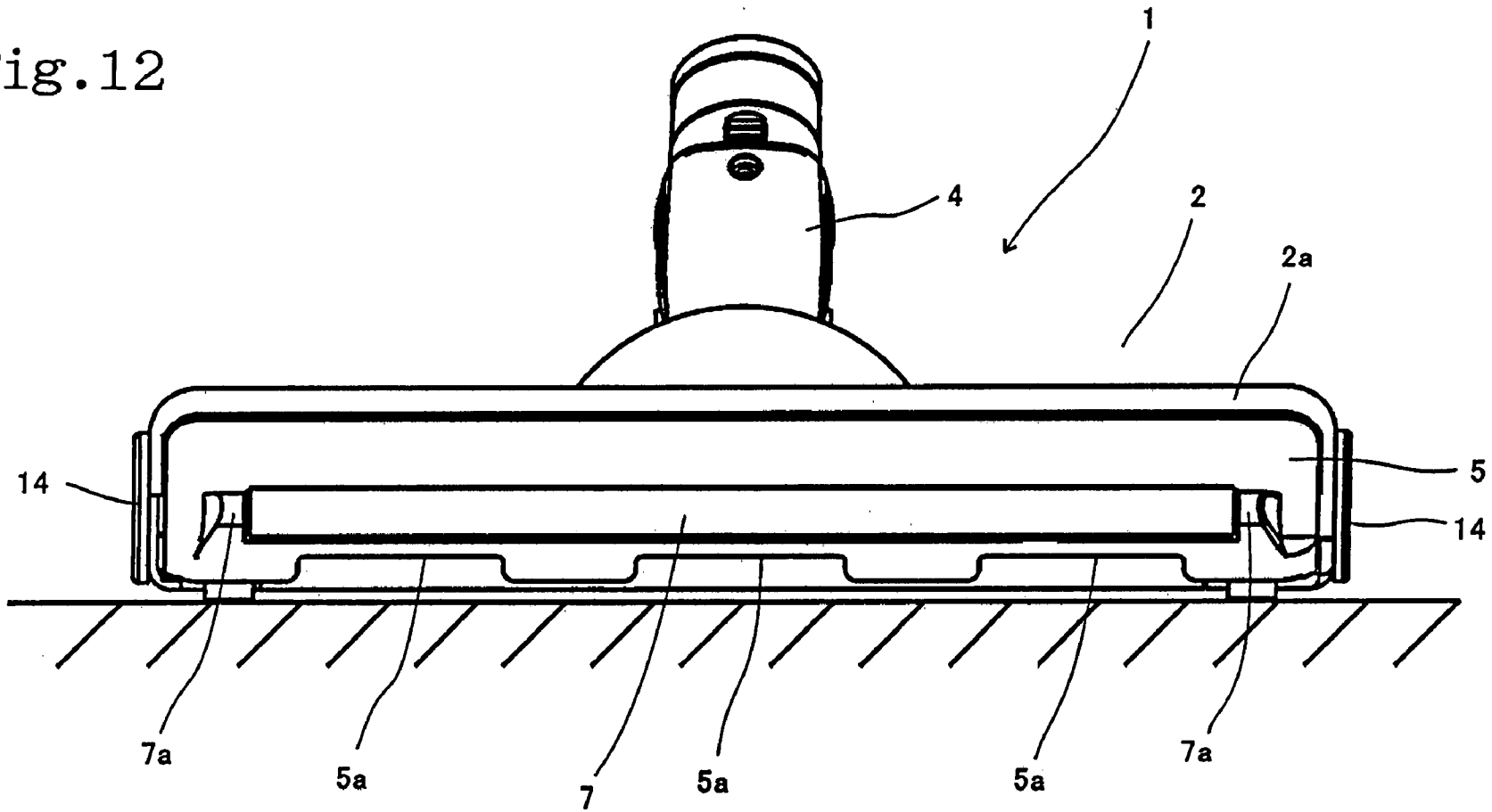
FIG. 12 is a front view of a floor suction tool in accordance with still another example of the present invention.
Figure 13:
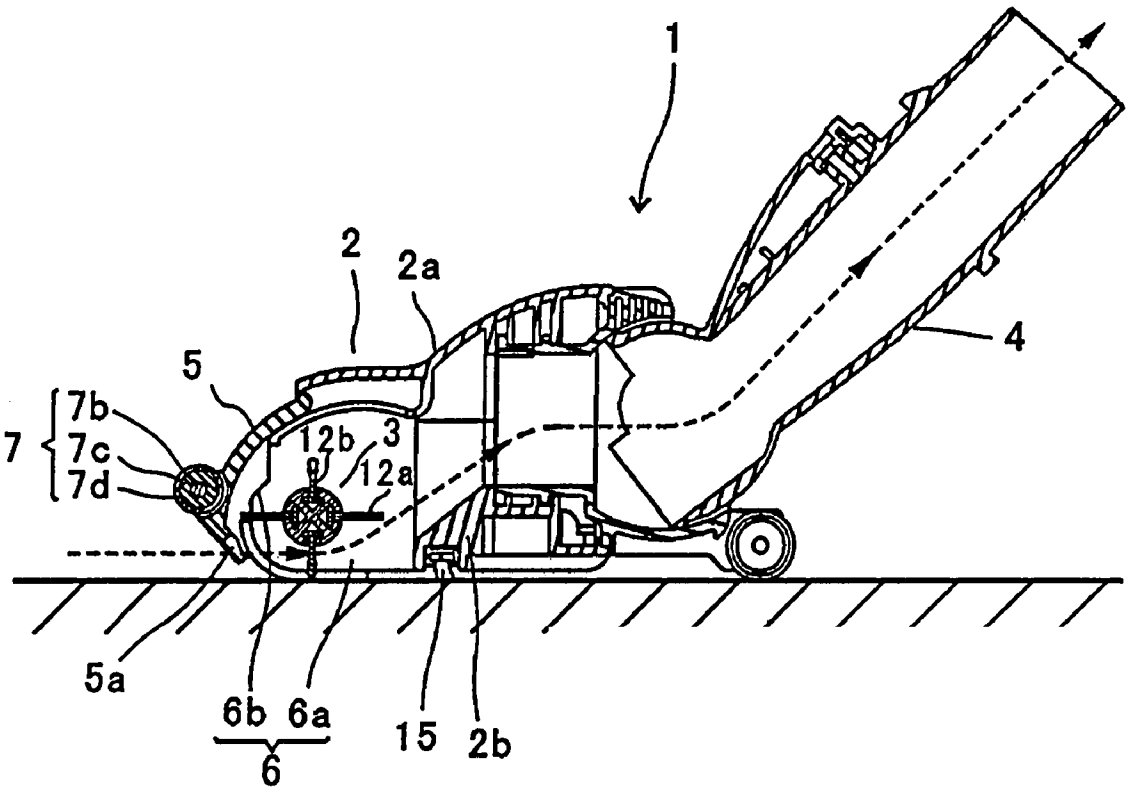
FIG. 13 is a vertical sectional view of a central part of the floor suction tool of FIG. 12.

In the above-described example, the invention is applied to the floor suction tool whose rotary brush 3 is a brush rotationally driven by a motor (a power brush). However, the invention is not limited thereto. The invention is also applicable to a floor suction tool with a turbine brush or a brush which is rotated by directly receiving sucked air using the rubber blade 12*b* of the rotary brush 3 or the like. In this case, for example, as shown in FIGS. 12 and 13, it is possible to provide a notch 5*a* in the center or one both sides of the bottom of the cover 5 for sucking air in the direction shown by an arrow in FIG. 13, which air is then received by the rubber blade 12*b* or the like to rotatably drive the rotary brush 3. In this suction tool, even while the cover 5 is opened by the abutment of the roller 7 to a wall, the rotary brush 3 is capable of rotating since air can pass through the outer periphery of the roller 7 made of the raising cloth 7*d* and through air paths ensured on both the sides. However, if rollers 71 and 72 are mounted on both the sides of the cover 5, air can be sufficiently taken between the rollers. Thus, the rotating force of the rotary brush 3 can be increased.

Figure 14:
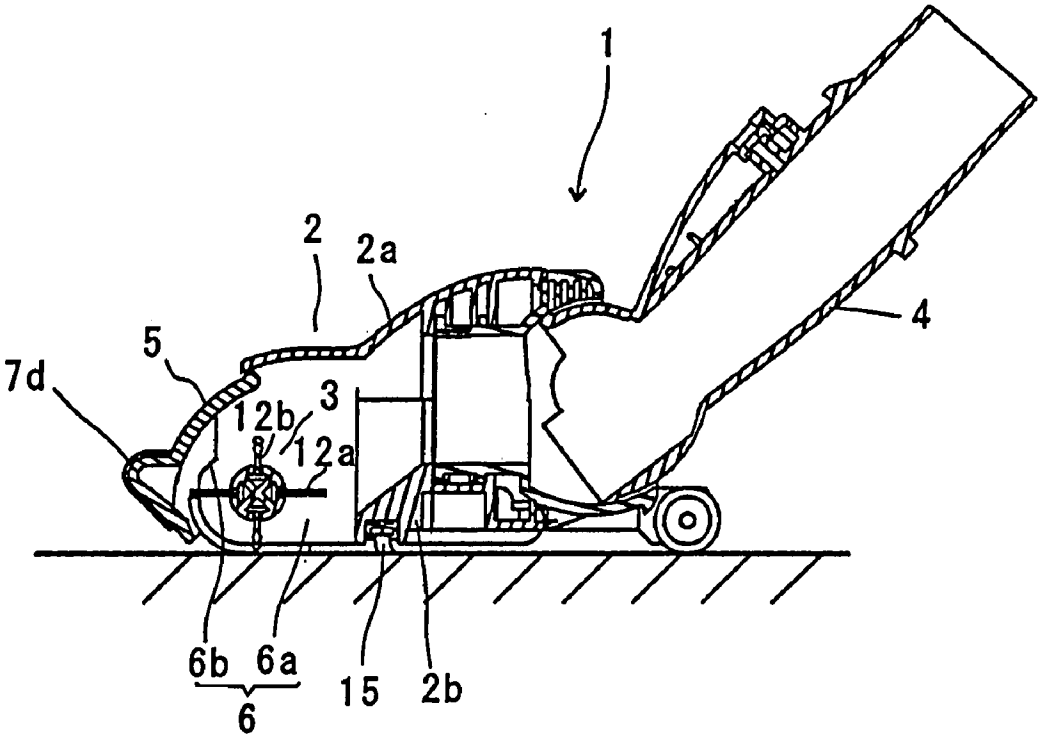
FIG. 14 is a vertical sectional view of a central part of a floor suction tool in accordance with still another example of the present invention.
Figure 15:
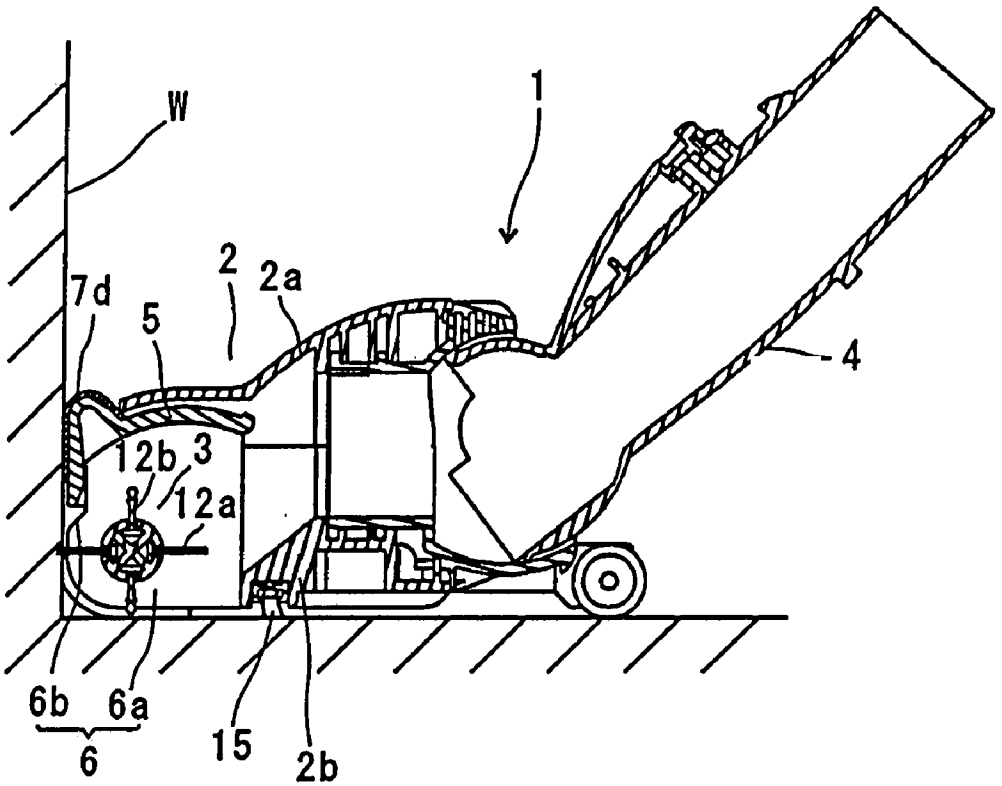
FIG. 15 is a vertical sectional view of the floor suction tool of FIG. 14 with a cover thereof opened.

In the above-described example, the roller 7 is provided in the cover 5. However, the invention is not limited thereto. For example, as shown in FIGS. 14 and 15, the cover 5 itself may have a projection projecting forward as an abutting member which abuts to a wall W and the outer surface of the projection may be covered with a raising cloth 7*d* as in the above-described example.

Figure 16:
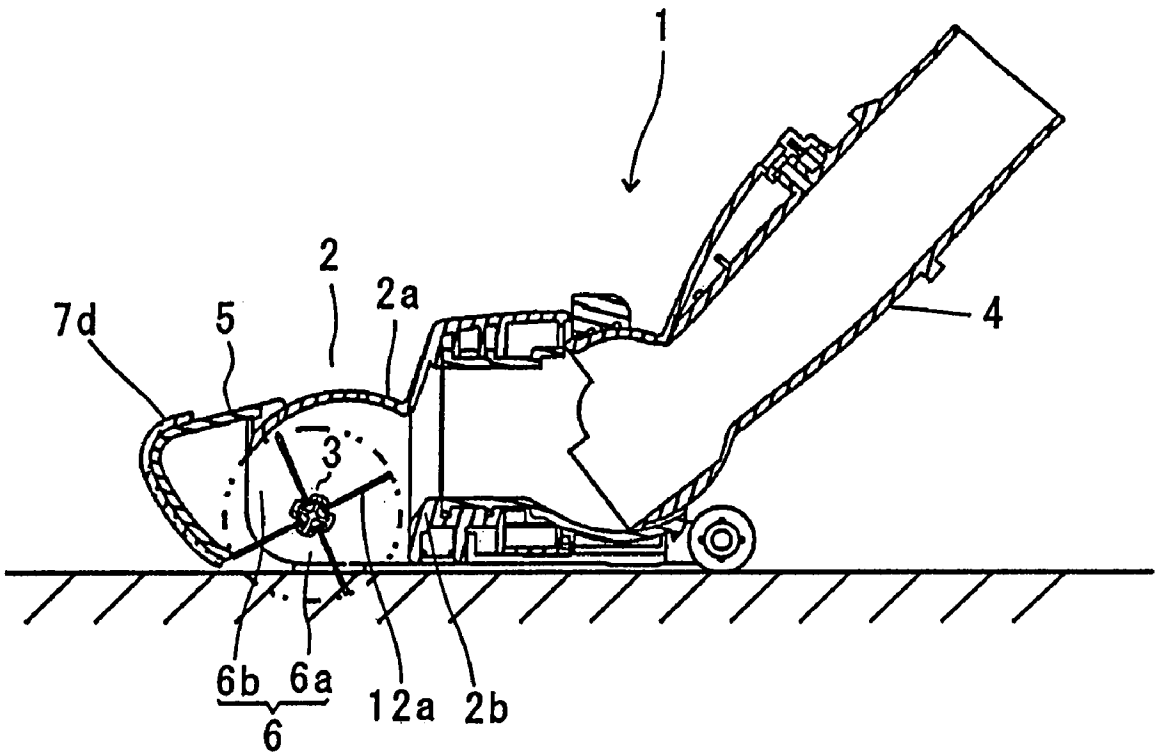
FIG. 16 is a vertical sectional view of a central part of a floor suction tool in accordance with still another example of the present invention.
Figure 17:
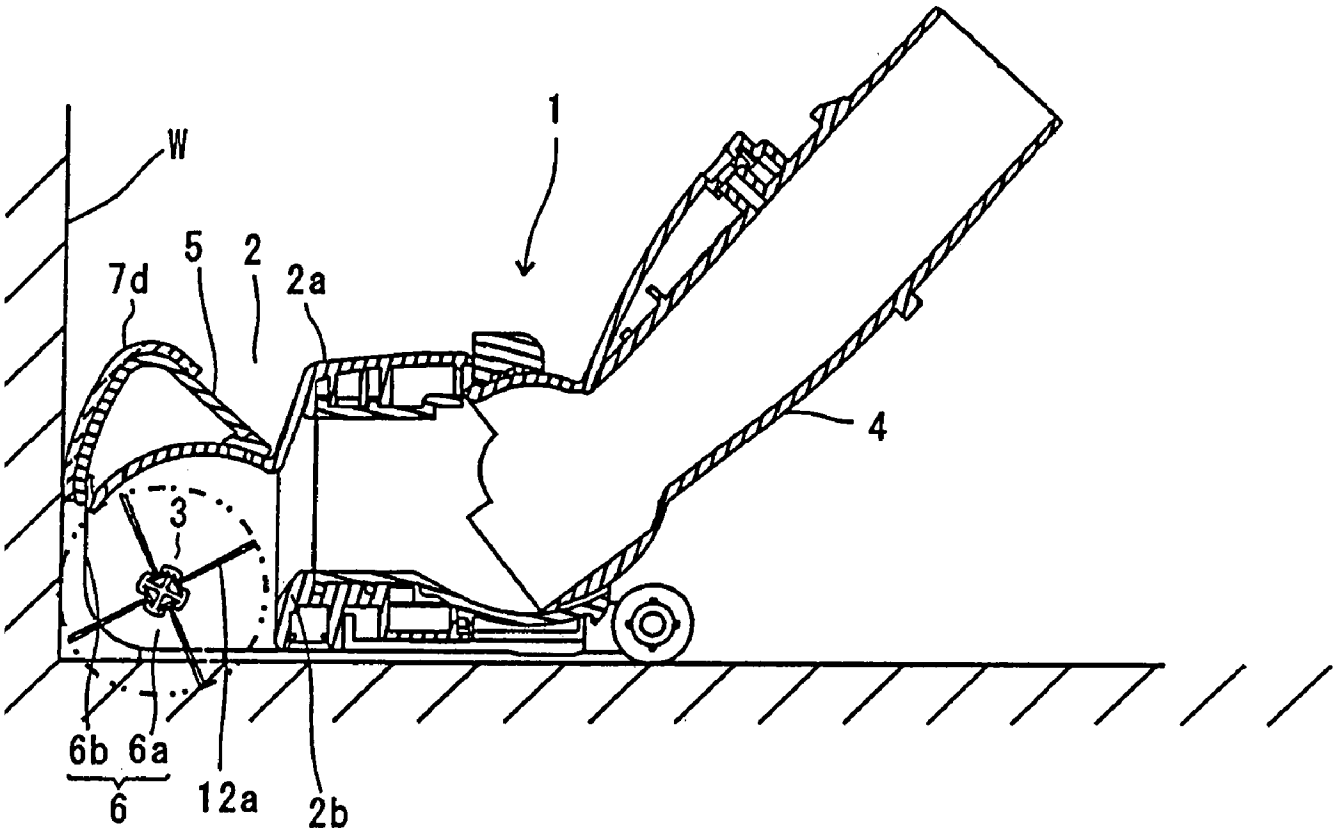
FIG. 17 is a vertical sectional view of the floor suction tool of FIG. 16 with a cover thereof opened.

In the above-described example, the cover 5 rotates in the direction in which the cover 5 is accommodated in the main body casing 2 when the floor suction tool 1 abuts the wall W. However, the invention is not limited thereto. For example, as shown in FIGS. 16 and 17, if the cover 5 rotates along the outside of the upper case 2*a* of the main body casing 2, the intended object of the invention can be achieved by covering a part of the cover 5 abutting to the wall W with a cloth 7*d* as in the above-described example.

As described above, according to the present invention, the floor suction tool 1 for electric vacuum cleaners includes the suction opening 6 formed on the bottom face of the main body casing 2; the cover 5 defining the front wall of the main body casing 2; and the abutting member projecting from the front face of the cover 5 and functioning as a bumper between the front face of the main body casing 2 and a wall. The cover 5 is rotatably supported on the rotation axis 7*b* formed horizontally in the width direction of the front wall of the main body casing 2. The cover 5 rotates upward to open the front face of the main body casing 2 when the front-to-back force acts on the abutting member. The cover 5 rotates downward to close the front face of the main body casing 2 when the front-to-back force ceases. Therefore, in cleaning at walls, the cover 5 is pushed up by pressing the suction tool 1 against the wall, so that the suction opening 6 approaches the wall. Thus dust gathering at the walls can be efficiently sucked.

The provision of the rotatable roller 7 as the abutting member allows the cover 5 to be rotated more smoothly.

The formation of at least the front surface of the abutting member of a soft, smooth material allows the abutting member to act as a shock absorber. That prevents walls and furniture from being marred by the suction tool 1 and also the cover 5 can be rotated smoothly. Further, smooth lateral movement of the suction tool 1 can be obtained when cleaning is carried out in the lateral direction with the abutting member abutting to the wall.

The use of a fibrous material, more particularly, a cloth as the soft, smooth material smoothens the lateral movement more when cleaning is carried out in the lateral direction with the abutting member abutting the wall.

With the construction wherein the cover 5 rotates in the direction in which the cover 5 is accommodated in the main body casing 2 of the suction tool 1, the suction tool 1 can have a reduced height. Thus, even in cleaning a place of low height, for example, under a bed, there does not occur a problem that the cover 5 fails to open because of hitting an obstacle. In addition, the suction tool 1 has a reinforced structure against external force.

With the construction wherein the rotary brush 3 is provided in the main body casing 2 and the rotation trajectory of the tips of the bristles 12*a* of the rotary brush 3 projects ahead of the abutting member when the cover 5 is open, dust on and at walls can be effectively removed.

The use of the bias means 9*a* for biasing the cover 5 downward can ensure the closing of the front portion 6*b* of the suction opening 6 even if more or less dust adheres to the rotation axis of the cover 5. The cover 5 may be so formed that its own weight acts as a force in the direction of closing the cover 5. Thereby it is possible to omit or simplify the bias means 9*a*.

What is claimed is:

1. A floor suction tool for electric vacuum cleaners comprising:

a suction opening formed on a bottom face of a main body casing; and a cover including a front portion defining a front wall of the main body casing, the front portion including a front face from which an abutting member projects forwardly to define a bumper between the front face and a wall of a room being cleaned;

wherein the cover is rotatably supported on a rotation axis oriented horizontally in the direction of width of the front wall of the main body casing, the cover being rotatable:

in a first direction when a front-to-back force acts on the abutting member, for moving the front portion and the abutting member upward and rearward to open the front face of the main body casing, and in a second direction when the front-to-back force ceases, for moving the abutting member and the front portion downward and forward to close the front face of the main body casing.

2. The floor suction tool according to claim 1, wherein the abutting member comprises a rotatable roller.

3. The floor suction tool according to claim 2, wherein an outer surface of the roller is covered with a smooth material.

4. The floor suction tool according to claim 3, wherein the smooth material is a fibrous material.

5. The floor suction tool according to claim 3, wherein the smooth material is a fibrous material.

6. The floor suction tool according to claim 4, wherein the fibrous material is a cloth.

7. The floor suction tool according to claim 6, wherein the fibrous material is a cloth.

8. The floor suction tool according to claim 1, wherein at least a surface of the abutting member is formed of a smooth material.

9. The floor suction tool according to claim 1, wherein the cover opens the front face of the main body casing by rotating along an inside face of an upper case of the main body casing and being received in the upper case.

10. The floor suction tool according to claim 1 further comprising, in the main body casing, a rotary brush having bristles fixed thereto radially, wherein the rotary brush is so formed that the tips of the bristles projects forward in relation to a trajectory of the cover when the cover opens.

11. The floor suction tool according to claim 1, wherein the cover is constructed to receive a spring force in a closing direction by a spring member attached to the rotation axis.

12. The floor suction tool according to claim 1, wherein the cover is so constructed that the weight of the cover acts as a force in a closing direction.

13. A floor suction tool for electric vacuum cleaners comprising:

a suction opening formed on a bottom face of a main body casing; and a cover having a front portion defining a front wall of the main body casing and including a front face from which an abutting member projects to define a bumper between a front face of the main body casing and a wall of a room being cleaned, wherein the cover is rotatably supported on a rotation axis oriented horizontally in the direction of a width of the front wall of the main body casing, the cover is arranged to rotate such that the front portion thereof moves upward to open the front face of the main body casing when a front-to-back force acts on the abutting member, and downward to close the front face of the main body casing when the front-to-back force ceases, wherein the abutting member comprises a rotatable roller.

14. The floor suction tool according to claim 13, wherein an outer surface of the roller is covered with a smooth material.

15. The floor suction tool according to claim 14, wherein the smooth material is a fibrous material.

16. The floor suction tool according to claim 15 wherein the fibrous material comprises a cloth.

17. A floor suction tool for electric vacuum cleaners comprising:

a suction opening formed on a bottom face of a main body casing; and a cover having a front portion defining a front wall of the main body casing and including a front face from which an abutting member projects to define a bumper between a front face of the main body casing and a wall of a room being cleaned, wherein the cover is rotatably supported on a rotation axis oriented horizontally in the direction of a width of the front wall of the main body casing, wherein the cover is arranged to rotate such that the front portion thereof moves upward to open the front face of the main body casing when a front-to-back force acts on the abutting member, and downward to close the front face of the main body casing when the front-to-back force ceases, wherein the cover opens the front face of the main body casing by rotating along an inside face of an upper case of the main body casing and being received in the upper case.

18. A floor suction tool for electric vacuum cleaners comprising:

a suction opening formed on a bottom face of a main body casing; and a cover having a front portion defining a front wall of the main body casing and including a front face from which an abutting member projects to define a bumper between a front face of the main body casing and a wall of a room being cleaned, wherein the cover is rotatably supported on a rotation axis oriented horizontally in the direction of a width of the front wall of the main body casing, wherein the cover is arranged to rotate such that the front portion thereof moves upward to open the front face of the main body casing when a front-to-back force acts on the abutting member, and downward to close the front face of the main body casing when the front-to-back force ceases, wherein the cover is constructed to receive a spring force in a closing direction by a spring member attached to the rotation axis.

* * * * *